United States Patent [19]

Varney

[11] Patent Number: 4,741,291

[45] Date of Patent: May 3, 1988

[54] WATER TUBE STEAM GENERATOR

[76] Inventor: John W. Varney, 242 Linwell Rd. Suit 106, St. Catherines, Ontario, Canada, L2N 1S2

[21] Appl. No.: 24,390

[22] Filed: Mar. 11, 1987

[51] Int. Cl.[4] ..... F22B 15/00; F22B 25/00; F22B 37/10

[52] U.S. Cl. ..... 122/235 MF; 122/240 R; 122/240 B

[58] Field of Search ..... 122/235 MF, 240 R, 240 B, 122/25, 23, 53, 138, 205, 287, 294, 304, 330

[56] References Cited

U.S. PATENT DOCUMENTS 2,334,187 11/1943 Frisch ..... 122/235 MF 3,089,467 5/1963 Armacost ..... 122/240 R 3,130,714 4/1964 Koel ..... 122/240 R

FOREIGN PATENT DOCUMENTS 0589498 1/1978 U.S.S.R. ..... 122/240 B

*Primary Examiner*—Edward G. Favors

*Attorney, Agent, or Firm*—McConnell and Fox

[57] ABSTRACT

A package steam boiler consists of four vertical combustion chambers surrounding a central vertical downcomer. A spherical steam drum is mounted at the top of the downcomer and a lower header is mounted at the bottom of the downcomer. The combustion chambers and downcomer are enclosed by tube-in-wall structures.

15 Claims, 4 Drawing Sheets

WATER TUBE STEAM GENERATOR

FIELD OF THE INVENTION

This invention relates to steam generators of the water tube type and particularly to what are referred to as packaged steam generators.

DESCRIPTION OF THE PRIOR ART

Packaged boilers are boilers which are manufactured in a substantially complete state and shipped to their site over normal transportation facilities. This requires that their dimensions be limited in order that they fit either a standard railway car or a flatbed truck which will move over the normal highway. In order to meet these requirements, it has been common practise in the past to design packaged boilers to have a certain height limited by the available headroom of railways and highways. Similarly, their length is limited by available flatbeds and flatcars. The result is that the steam capacity of packaged boilers is limited by the available heat transfer surfaces and the circulation pattern which together determine the steam capacity of the boiler. In natural circulation boilers, which are the commonest form, in which convection is the driving force, it will be evident that the convection forces will be a function of the height of the boiler. In those packaged boilers having limited height, it will also be evident that the circulation forces will be limited by the height restriction.

While some efforts have been made in the past to increase the length of the water tubes by shipping the packaged boiler in a horizontal position and then erecting on site in a vertical position such as in the case of the packaged boiler marketed under the trade name "Towerpak" by Babcock and Wilcox, the design has not provided the ultimate in circulation and, as is common in many boiler constructions, virtually every water tube has to be shaped to fit the boiler and at the same time fit the steam or mud drum at the top or bottom of the boiler.

As a result, boilers of the prior art do not maximize capacity and because of the formation of the water tubes are difficult to manufacture and repair.

SUMMARY OF THE INVENTION

In accordance with the present invention, the boiler comprises four separate burners firing vertically upwards through four radiation sections. In the centre of these four radiation sections is a downcomer isolated from the radiation sections by a sealed barrier wall of water tubes. Each radiation section is formed from barrier walls of water tubes. Adjacent each of the radiation chambers is a convection section containing water tubes which function as economizer tubes. The water tubes in the radiation section and in the convection section are connected to headers which all connect into a common spherical steamdrum which sits centrally above the firing chambers and is connected to the central downcomer. Super heater tubes project downwardly into the radiation section of each quadrant of the package and are connected to headers and thus to the steam outlet. The downcomer is connected through a plurality of headers at the bottom of the boiler to all the radiant tubes and to the convection tubes. An enlargement at the base of the downcomer to accommodate these headers functions as a mud drum. The arrangement of the four sections around a central downcomer, when coupled to a spherical steam drum, provides a symmetrical arrangement which promotes maximum circulation and the separation of the four radiant chambers by means of tube wall construction maximizes the radiant surface exposed to the combustion products.

DESCRIPTION OF THE PREFERRED EMBODIMENT

Figure 1:
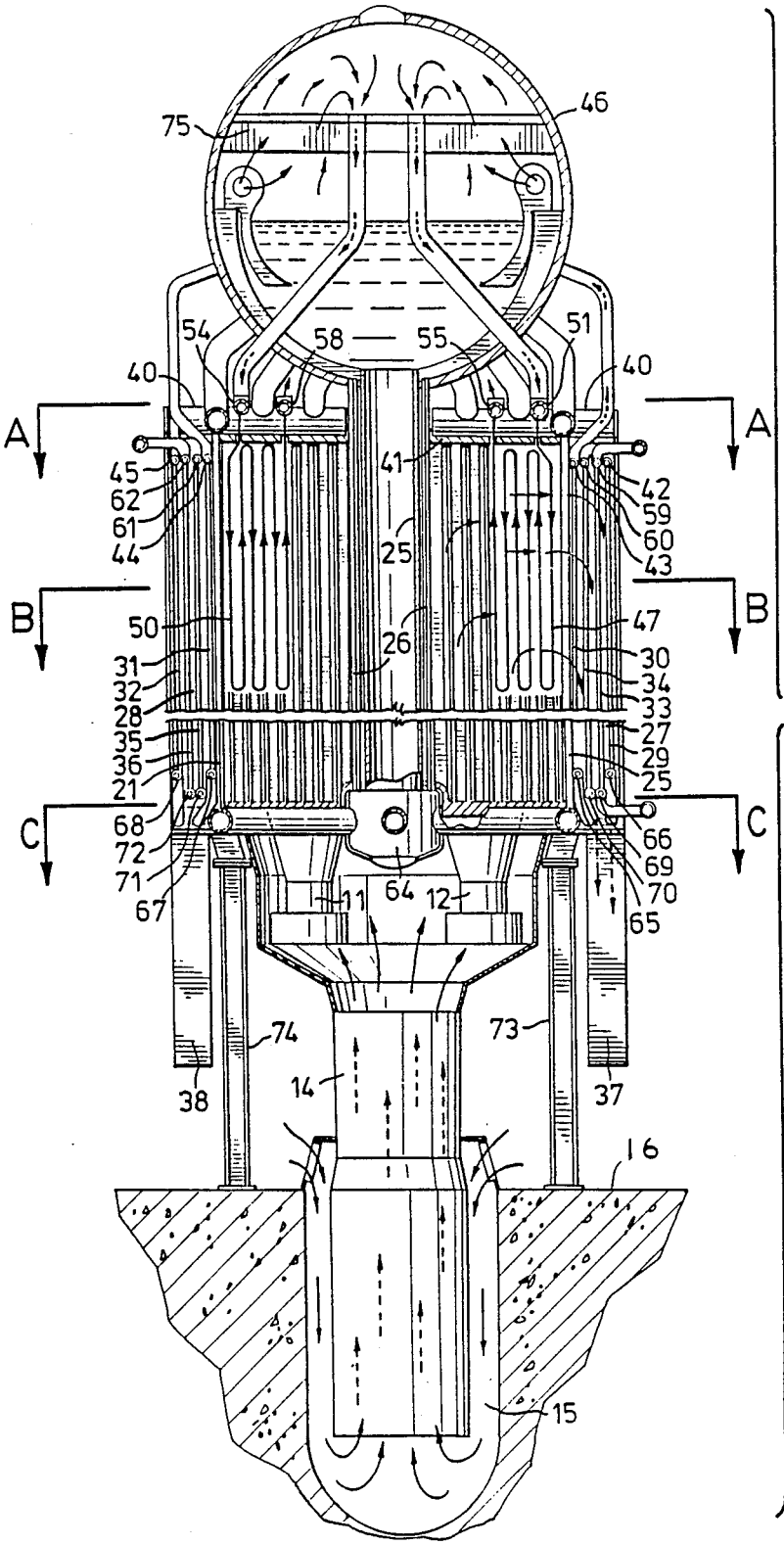
FIG. 1 is an elevational sectional view of the package boiler in accordance with my invention.
Figure 3:
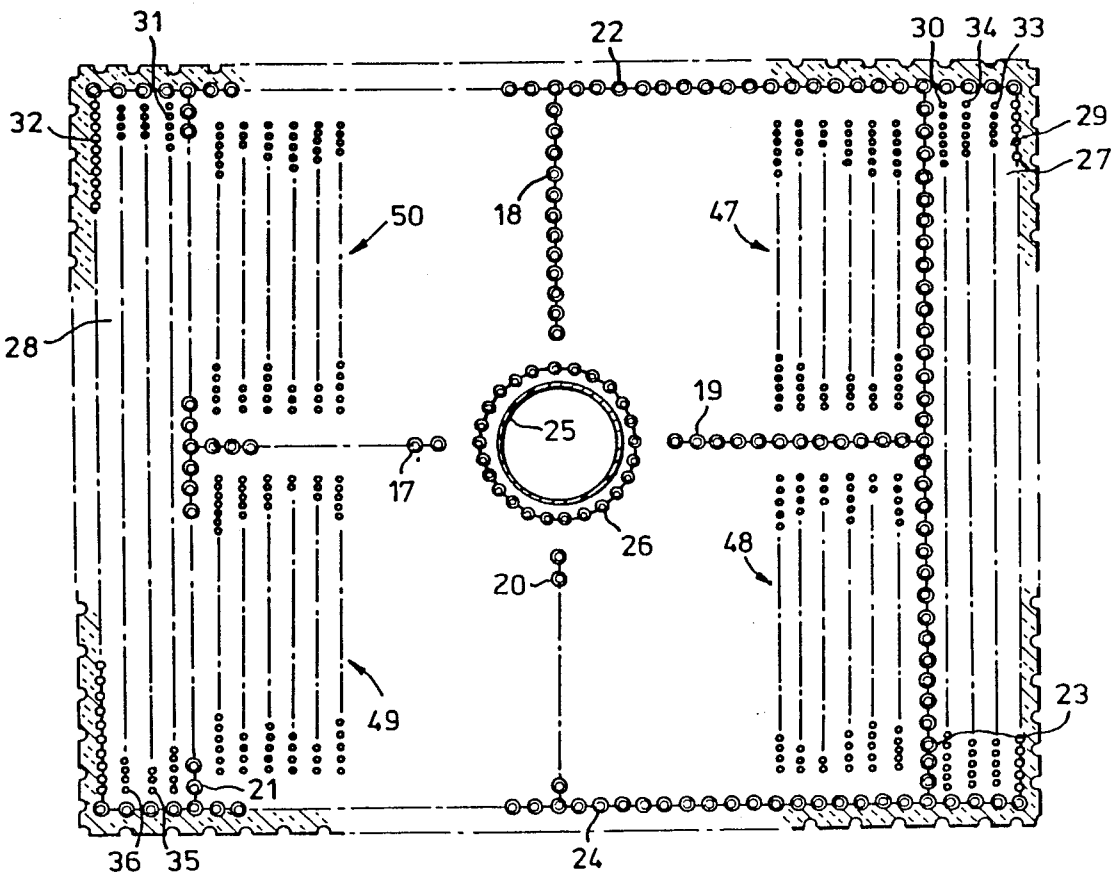
FIG. 3 is a cross-sectional view of the boiler of FIG. 1 on section lines BB.
Figure 4:
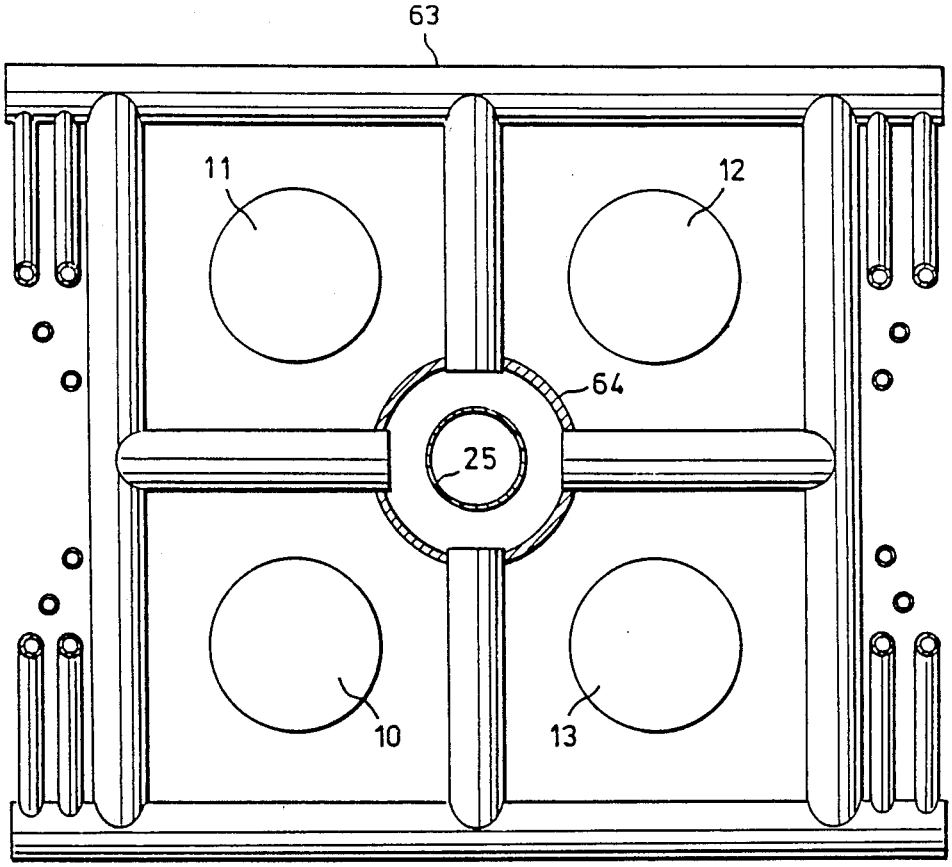
FIG. 4 is a cross-sectional view of the boiler of FIG. 1 at section line CC.

As seen in FIGS. 1 and 4, the boiler is a vertical arrangement with burner units 10, 11, 12 and 13 at the base, fed with air from a multi-stage axial fan 14 which draws combustion air through a silencer assembly mounted in the base supporting the boiler, which is a concrete pad designated 16. The combustion gases from the burners travel upwards through four vertical parallel combustion chambers which, as will be more clearly seen in FIG. 3, are separated from each other by division walls 17, 18, 19 and 20 which project inwardly from the furnace sidewalls 21, 22, 23 and 24, towards the center of the furnace where the central downcomer 25 is located. The downcomer is isolated from the furnace combustion chambers by a tube wall 26. The combustion gases pass out from the combustion chambers into the return paths comprising chambers 27 and 28, shown in FIG. 3, which contain the convection tubes 29 and 30 on each side of chambers 27, 31 and 32 on each side of chamber 28. Also within the chambers 27 and 28 are the economizer banks 33 and 34 within chambers 27, 35 and 36 within chamber 28.

The walls of the combustion chambers 21, 22, 23 and 24, the separating walls 17, 18, 19 and 20, and the external walls of chambers 27 and 28, all consist of tubes having fins on each side, which are welded together to form a gas-tight wall, which as will be understood, incorporates the tubes within the wall structure. Thus the convection bank tubes on the outer surfaces of chambers 27 and 29 are incorporated within the outer wall of the chamber while the inner banks 30 and 31 consist of free-standing tubes. The combustion gases therefore are free to flow between the free-standing tubes, the combustion gases then pass down through chambers 27 and 28 and out through the bottom of the boiler to a pair of flue ducts 37 and 38 which in turn are connected to a common stack 39 as shown in FIG. 2.

Figure 2:
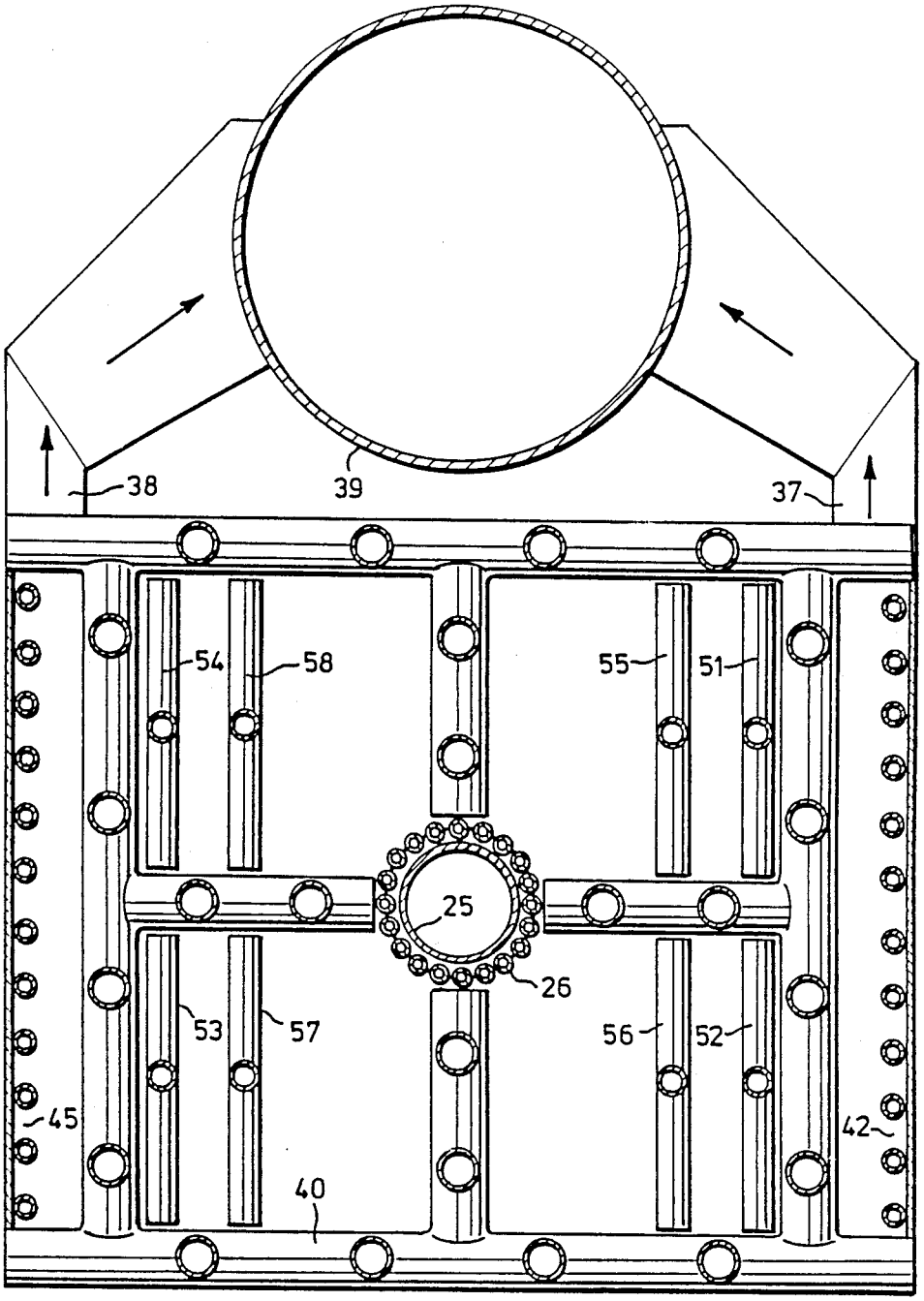
FIG. 2 is a cross-section of the boiler of FIG. 1 at section line AA.

The tubes in walls 17, 18, 19. 20, 21, 22, 23 and 24 are all connected to headers which together form a substantially rectangular header structure 40 shown in FIG. 2. This header structure lies above the lower surface of the upper wall of the furnace structure designated 41 as shown in FIG. 1. The junction between the tubes of the wall 17–24 and the header structure is therefore protected from the combustion gases by the presence of the upper furnace target wall 41.

The convection bank tubes are connected to headers 42, 43, 44 and 45 as shown in FIG. 1. A plurality of risers connected from headers 40, 42, 43, 44 and 45 all connect to a steam drum which is spherical and designated 46.

At the upper end of the combustion chamber are four super heater sections 47, 48, 49 and 50 as shown in FIG. 3, which are connected to the steam drum through headers 51, 52, 53 and 54 and to the steam outlet through steam outlet headers 55, 56, 57 and 58. The economizer tubes are connected to headers 59, 60, 62 and 62 and by means of risers to the steam sphere 46.

The mixture of steam and water from the header 40 and from headers 42, 43, 44 and 45 enters the steam drum and the steam is separated from the water in the normal manner and dried passing through driers 75 with the steam occupying the upper portion of the steam drum and the water occupying the lower portion. The separated steam passes into the super heaters through headers 51, 52, 53 and 54 and out of the super heaters into steam outlet. The separated water is returned to the downcomer 25 which is connected to the bottom of the inner portion of the steam drum as clearly shown in FIG. 1. At the bottom of the boiler is header 63, shown in FIG. 4, of a configuration similar to header 40, is connected to the tubes in walls 17–24 inclusive. The portions of header 63 which are connected to walls 17, 18, 19 and 20 respectively, are connected at their inner ends to an enlargement 64 at the base of the downcomer tube 25 as shown in FIG. 1 and 4.

The convection banks in chamber 27, designated 29 and 30, are connected to headers at their lower ends. These headers are designated 65 and 66. Similarly, the convection banks 31 and 32 in chamber 28 are connected to headers 67 and 68. Headers 65, 66, 67 and 68 are connected through feeders to header 63 as shown in FIGS. 1 and 4. Thus the water from the downcomer 25 is connected to the base of all the heater tubes, including the radiant heater tubes forming the combustion chambers and comprising the walls 17–24 inclusive and also, the convection tubes comprising the outer walls 29 and 32 and the convection tubes comprising banks 30 and 31. The economizer tubes are connected through headers 69, 70, 71 and 72 to the boiler feed water main.

The whole boiler structure is supported by a plurality of columns, such as 73 and 74 shown in FIG. 1, which are connected to the lower header 63 and mounted on the base pad 16.

Because of the dimensions of the structure, it can be substantially wholly assembled in the factory. The overall dimensions are such as to permit transport over normal road or rail lines of the complete assembly including the steam drum, and the economizer tubes which are all assembled within the package at the factory. On site, it is only necessary to provide a suitable concrete pad, install the super heaters, and mount the boiler assembly on the columns 73 and 74. The burners, axial flow fan and silencer may then be installed. Flue ducts 37 and 38 may then be connected to the stack 39 which will be assembled on site. With the feed headers 69–72 connected to the boiler feed water main and the steam outlet headers 55, 56, 57 and 58 connected to the load, the boiler is ready for operation.

In operation, the burners produce a suitable combustion mixture which is ignited and the gases flow upwards through the furnace chambers to the upper end, where the gases pass through walls 21 and 23. It will be understood that in these walls the fins between the tubes are omitted at their upper end to permit the combustion gases to pass outwards into chambers 27 and 28 respectively. The combustion gases then flow downward through chambers 27 and 28 down through the flue ducts 37 and 38 to the stack 39 and then up and out to atmosphere.

The water in all the radiant surface furnace walls and in the convection banks is heated by the combustion products and rises into the steam sphere. Here steam and water is separated and the water returned down through the downcomer to the lower header 63. The separated steam is passed through the steam driers 75 and then the super heater sections and out to the load.

Because of the arrangement of the furnace in a vertical direction, the combustion gases have no tendency to impinge more on one wall than the other and therefore, the energy from the combustion gases is relatively evenly proportioned amongst the radiant walls and the convection bank tubes. This symmetrical arrangement encourages a substantially balanced utilization of the tubes contribute substantially equally to absorption of energy from the combustion products with a balanced flow through the various tubes. Also, because of the symmetrical arrangement, the length of the tubes exposed to the combustion gases is substantially equal and this also provides for a balanced fluid flow. The vertical arrangement also encourages the flow because of the vigorous pumping action produced by the heating which causes vigorous flow through the vertical tubes to the steam drum. The central location of the downcomer also contributes to the balanced configuration and encourages a vigorous and balanced circulation of fluid through the various tubes.

The incorporation of the economizer bank within the gas return flow in chambers 27 and 28 makes for simplicity of structure meaning that the user can receive a single package which incorporates both convection tubes, radiation tubes, super heater tubes and economizer tubes. The inter-mixing of the convection surfaces and the economizer bank in chambers 27 and 28 means that the outgoing gases which enter the flue ducts are at a temperature determined by both the temperature of the convection bank tubes and the economizer bank tubes. The economizer bank tubes at their lower end, of course, are at the input water temperature, while the convection bank tubes are at the temperature of the water in the downcomer. The result is that the average gas temperature is relatively low.

It will be noted that the barrier 26 which surrounds the downcomer 25 is also connected to the steam sphere and to the enlargement 64 thus ensuring that the downcomer is insulated from the combustion gases. The barrier 26 is also constructed of finned tubes which form a gas-tight seal around the downcomer 25.

Because of the balanced structure and the simple design utilizing relatively straight headers and a limited number of risers, the tubes exposed to the combustion products, such as the tubes in the separator walls and furnace walls, are all straight and all the same length. In the same way, the convection tubes are straight and most of the same length. Economizer tubes are all straight and of the same length. The result is a very robust boiler and one which is easily repaired. In the event of a tube failure, a tube of substantially fixed length and straight, may easily be replaced.

The arrangement of the headers and their associated risers which connect them to the steam sphere is also very simple, minimizing the number of connections into the steam sphere and the connections between the header and steam sphere, that is the risers, are all outside the combustion area thus minimizing the stress on the connections.

The super heaters are four bundles as shown more clearly in FIGS. 2 and 3 and are connected to risers 51 through 58 as shown in FIG. 2. In the event of failure all or any one of the super heaters can be disconnected from its header and lowered through the furnace and out through the bottom furnace wall for removal and repair.

The steam sphere has advantages over the normal steam drum because, of course, it is symmetrical and provides a balanced supply to the downcomer from four quadrants of the furnace, and in addition, for a given volume, provides better access and height for inspection and repair.

The vertical mounting of the boiler, of course, has advantage in that it minimizes the ground space necessary.

Because the super heater units are pendant from the upper portion of the boiler, they may be shipped separately and installed on site by introducing them from the lower end of the boiler, raising them to the upper end and connecting them as necessary to their headers. The floor of the furnace may then be installed together with the burners. The outer surface of the boiler, that is the outer surface of walls 22, 24, 29 and 32 will be covered with a suitable insulating material and this with a protective sheathing, such as corrugated steel.

While no specific dimensions have been provided, it will be understood that due to shipping limitations in North America, the overall length from the top of the steam sphere to the bottom of header 63 and its support elements should not exceed 63 feet. The width of walls 29 and 32 including the exterior sheathing should not exceed 12½ feet, and the length of walls 22 and 24, including the exterior sheathing, should not exceed 16 feet. With these dimension limitations, the whole package may be shipped over normal transportation roads or railways.

Under some circumstances the risers from headers 44, for example, may have to be removed for shipping because the bed of the vehicle is not flat. Because of their simple form and limited number, they can readily be removed and replaced on site.

I claim:

1. A natural circulation package boiler comprising a plurality of identical vertical combustion chambers symmetrically arranged around and open to a central vertical downcomer, a spherical steam drum mounted on and supported by and connected to said downcomer, a first header assembly at the lower end of said boiler including a central enlargement on which said downcomer is mounted and to which it is connected, a second header assembly at the upper end of said boiler, a plurality of radiation tubes interconnecting said first and second headers all of said radiation tubes being linear and a plurality of risers interconnecting said second header and said steam drum each of said combustion chambers including a vertically upward firing burner.

2. A package boiler as claimed in claim 1 including at least two symmetrically arranged return path chambers, one on each exterior side of said combustion chambers and open thereto to provide a path for combustion gases from said combustion chambers into said return path chambers and down into the base of a stack.

3. A package boiler as claimed in claim 1, 2 or 3 radiation tubes are incorporated into the side walls of said combustion chambers.

4. A package boiler as claimed in claim 1, 2 or 3 wherein said downcomer is snugly surrounded by a wall incorporating radiation tubes.

5. A package boiler as claimed in claim 2 including a plurality of convection tubes within said return path chamber.

6. A package boiler as claimed in claim 2 or 5 including a plurality of preheater tubes within said return path chamber.

7. A package boiler as claimed in claim 5 wherein at least a portion of said convection tubes are incorporated into the sidewalls of said return path chambers.

8. A package boiler as claimed in claim 1, 2 or 3 including a super heater unit at the upper end of each of said combustion chambers.

9. A natural circulation package boiler comprising a central downcomer, four combustion chambers, each chamber including a vertically up firing burner said chambers surrounding said downcomer and isolated from the downcomer only by a cylindrical wall snugly surrounding said downcomer, a pair of return path chambers one on each of two sides of said combustion chamber, each return path chamber spanning two combustion chambers, a first header assembly at the upper end of said combustion chambers and connected to vertical radiation tubes within said combustion chambers, a second header assembly at the lower end of said combustion chambers connected to said radiation tubes and to the lower end of said downcomer, a spherical steam drum mounted on and supported by and connected to the upper end of said downcomer and a plurality of risers connecting said first header assembly to said stream drum, all of said vertical radiation tubes being linear.

10. A package boiler as claimed in claim 9 including a plurality of vertical linear convection tubes arranged within said return path chambers.

11. A package boiler as claimed in claim 9 including a plurality of vertical linear convection and preheater tubes arranged within said return path chambers.

12. A package boiler as claimed in claim 9, 10 or 11 wherein radiation tubes are incorporated into the walls of said combustion chambers.

13. A package boiler as claimed in claim 9, 10 or 11 wherein radiation tubes are incorporated into said cylindrical wall

14. A package boiler as claimed in claim 10 or 11 wherein convection tubes are incorporated into the sidewalls of said return path chambers.

15. A package boiler as claimed in claim 11 wherein said convection tubes and said preheater tubes are parallel and adjacent.

* * * * *